US005460087A

United States Patent [19]

Ogorzalek

[11] Patent Number: 5,460,087

[45] Date of Patent: Oct. 24, 1995

[54] STENCIL SET FOR DECORATIVE WINDOW TRIM

[76] Inventor: William D. Ogorzalek, 100 Timberline Ct., Danville, Calif. 94526

[21] Appl. No.: 307,266

[22] Filed: Sep. 15, 1994

[51] Int. Cl.[6] ..... B05C 17/06; B05C 17/00

[52] U.S. Cl. ..... 101/128.21; 101/128.4; 101/114; 101/112

[58] Field of Search ..... 101/112, 114, 101/128.4, 129, 128.21; 434/87; D19/40; 33/562–565

[56] References Cited

U.S. PATENT DOCUMENTS

| | | | |
|---|---|---|---|
| D. 253,462 | 11/1979 | Packard | D19/40 |
| 2,251,647 | 8/1941 | Wartha | 101/112 |
| 4,023,524 | 5/1977 | Goldfarb et al. | 101/114 |
| 4,397,261 | 8/1983 | Jones | 118/505 |
| 4,550,683 | 11/1985 | Jones | 101/128.4 |
| 4,852,483 | 8/1989 | Bussard | 101/114 |
| 5,228,858 | 7/1993 | Fromm | 101/328 |
| 5,335,433 | 8/1994 | Borden | 40/152 |
| 5,378,419 | 1/1995 | Capoccia | 264/162 |

*Primary Examiner*—Edgar S. Burr
*Assistant Examiner*—Lynn D. Hendrickson
*Attorney, Agent, or Firm*—Bielen, Peterson & Lampe

[57] ABSTRACT

A stencil kit for applying decorative patterns and designs to architectural structures in which the kit includes one or more stencil templates fabricated from a closed-cell foam sheet with pattern and design cut-outs through which paint is applied to the surface of the architectural structure, the foam sheet having a contact side with a temporary stick adhesive for adhering the template to the surface of the architectural structure, and a top side with a surface allowing removal of misapplied paint, the stencil kit also including paint and stipple brushes for application of the patterns and designs.

7 Claims, 1 Drawing Sheet

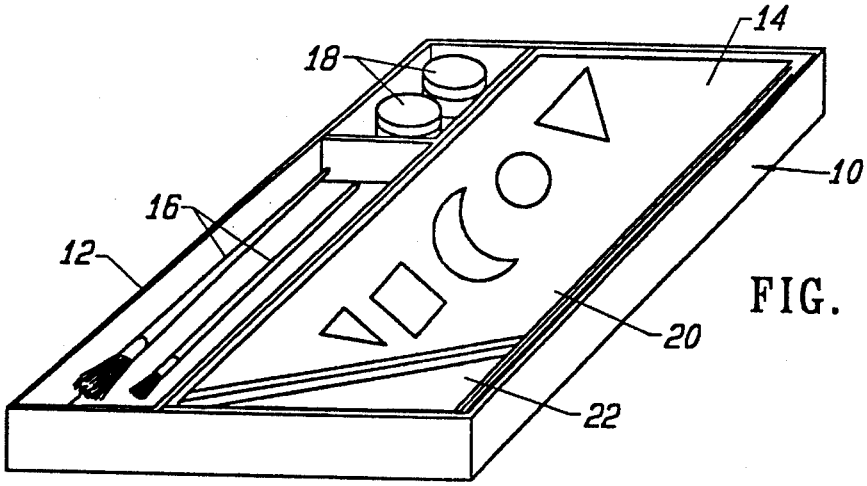
FIG. 1
FIG. 2
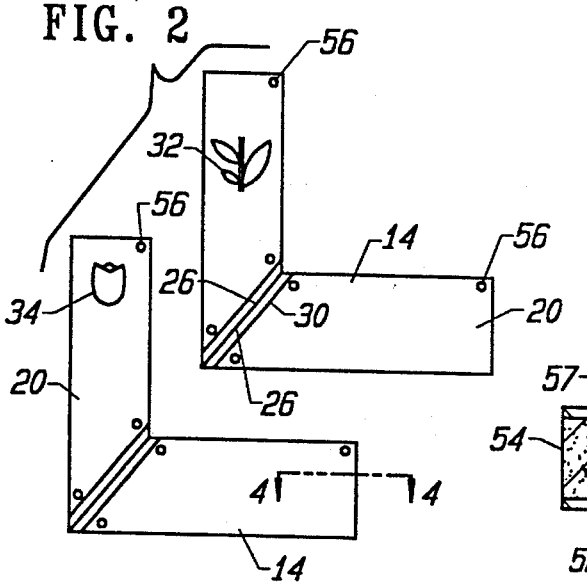
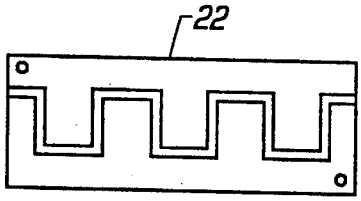
FIG. 3
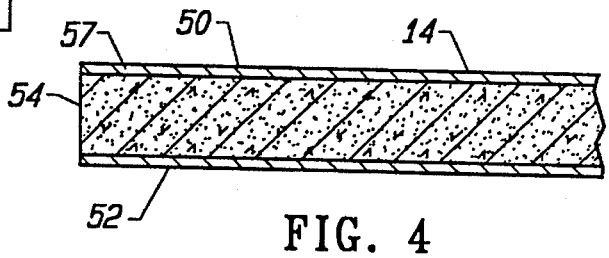
FIG. 4
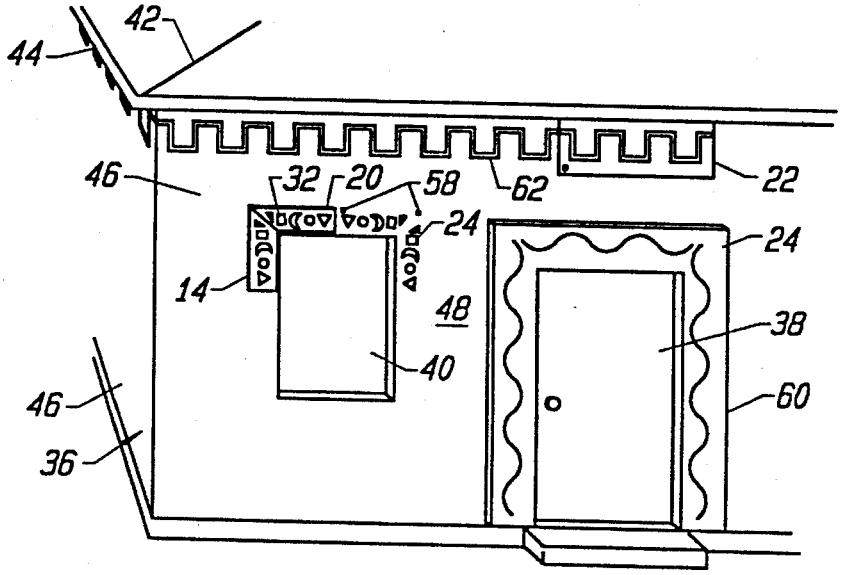
FIG. 5

STENCIL SET FOR DECORATIVE WINDOW TRIM

BACKGROUND OF THE INVENTION

This invention relates to a stencil kit for applying decorative trim patterns to outdoor and indoor structures such as houses, commercial buildings, walls and the like. Heretofore, decorative patterns have been applied to exterior and interior surfaces directly as original art or by using a paper stencil as a guide to draw an outline of pattern to be painted on the surface. The surface texture of exterior structures in particular has made it impractable to use conventional stencils for direct application of paint to the surface. Because the surface to be decorated is usually vertical, conventional stencil templates do not adequately prevent paint from migrating under the stencil template.

Where a building is constructed with stucco wall surfaces, frequently the design of the building is of a type that is plain, without shutters or other window ornamentation. This type of structure is particularly amenable to decorative enhancements of the type that can be applied using the kit of this invention. Because of the rough surface exterior, even directly applied artwork using a brush is difficult. The textured surface does not permit the use of conventional stencil templates except for outlining, and therefore, decorative, painted ornamentation usually must be applied by professionals. The use of decorative flower patterns, vine or vineyard patterns and other plant-life adornment is currently popular for Mediterranean style homes. The use of decorative geometric patterns continues to be popular with art deco or greco style commercial buildings. Frequently, both interior and exterior masonry surfaces in such structures are textured and may be improved in appearance by decorative surface ornamentation.

Using the template kit of this invention, different designs can be constructed using multiple templates in a set to achieve multi-colored patterns and intricate designs enabling a stencil kit to be adapted for a variety of different style applications.

The improved stencil kit of this invention is designed for use on the interior or exterior of architectural structures for inexpensive ornamentation. The stencil kit is designed for use by nonprofessionals such as homeowners, and provides a quick and easy system for improving the appearance of the structure. The stencil kit is particularly useful where the wall surface of the structure is textured and conventional stencils are inadequate.

SUMMARY OF THE INVENTION

The stencil kit of this invention provides a system for ornamenting structures, particularly rough, exterior surfaces where conventional stencil templates are not readily useable. The stencil kit includes one or more stencil templates that are fabricated from a closed-cell foam with a stiff backing. Each stencil template has one smooth surface, allowing excess paint to be wiped clean for reuse, and a contact surface with a temporary stick mastic. The fabrication of the template from a closed cell foam allows the contact surface to adapt and conform to a textured surface with the mastic providing a sealing that prevents paint from migrating under the stencil template when applied to a surface. The mastic additionally holds the template in place during the painting part of the stenciling operation.

The stencil kit also includes one or more stipple brushes and the necessary paints to produce a particular pattern or design. It is to be understood that in the preferred embodiment, kits feature different patterns or designs with precut templates. The templates are die-cut and feature patterns or designs that are either complete or simply pre-registered segments of a design or pattern that can be repeated to the desired finish length by repeatedly applying and moving the template along the length of the intended ornamentation by means of register. Similarly, the die-cut, mitered templates may be formed as corner sections for framing a window or doorway with a pattern or design. Preferably, the paint is a water-base, brightly-colored, exterior paint of paste-like consistency to inhibit running and to be conducive to quick-drying. The use of stipple brushes enables the open portions of the stencil pattern to be easily filled even when the exposed surface is textured.

The smooth outer surface of the closed-cell sponge sheets forming the template may be unitary with the sheet and formed during fabrication, or formed by a laminated sheet of thin plastic or wax impregnated paper that is bounded to the surface of the sponge sheet. Since it is intended that the stencil templates may be repeatedly used, for example, in completing an extended ornamentation by segments, the mastic that forms the contact surface will repeatedly adhere to a structural surface, and the smooth, outer surface can be easily cleaned of surface paint. In the event the mastic on the contact surface begins to lose its capability to adhere, the surface can be recoated with a temporary-stick adhesive from a spray that can either provided with the kit or purchased separately.

The stencil kit is designed for inexpensive production for sale in art stores, hardware stores, department stores or any location where home improvement or do-it-yourself products are sold.

BRIEF DESCRIPTION OF THE DRAWINGS

FIG. 1 is a perspective view of the stencil kit contained in an uncovered box.

FIG. 2 is a top plan view of two typical stencil templates used to form a composite pattern for ornamentation of a building structure.

FIG. 3 is a top plan view of two stencil templates forming a stencil composite for a design for ornamentation of a building structure.

FIG. 4 is an enlarged partial cross sectional view of the stencil template taken on the lines 4—4 in FIG. 2.

FIG. 5 is a typical structure on which stencil ornamentation of a typical structure showing ornamentation using the stencil kit of this invention.

DETAILED DESCRIPTION OF THE PREFERRED EMBODIMENTS

Referring to FIG. 1, the stencil kit, designated generally by the reference numeral 10, is shown in the form of an uncovered box 12 containing the primary components, including a plurality of stencil templates 14, stipple brushes 16 and paint jars 18. It is to be understood that the contents of the stencil kit can be varied and that the kit shown in FIG. 1 is for exemplar purposes. The stencil kit 10 of FIG. 1 includes pattern templates 20, shown in FIG. 2 and a design template 22 shown in FIG. 3. Typically, pattern templates 20 and design templates 22 are used on architecturally different styled buildings and are therefore not provided in the same stencil kit box. However, because the stencil templates are identically constructed, for convenience they are shown as part of a single kit.

Referring to FIG. 2, the stencil templates 14 for a typical kit comprise two pattern templates 20 for a two color pattern to be applied to a structure for decorative corner ornamentation 24 around doors and windows as shown in FIG. 5. The corner ornamentation 24 is achieved by a pattern template 20 having an L-shaped configuration that is formed by mitered ends 26 of template segments 28 that are coupled by a tape 30 on one side of the template segments 28. In this manner, the segments can be folded flat for storage as shown in FIG. 1. The two-color corner ornamentation 24 of FIG. 5 is achieved by the sequential use of two pattern templates 20, one having a first pattern 32 applied to the structure to be painted, and after drying, another having a second pattern 34 applied in areas not covered by the first pattern.

Referring to FIG. 5, a typical architectural structure 36 to which the stencil ornamentation is to be applied is shown to illustrate the application of both styles of stencil ornamentation. The structure 36 is a typical home having a door 38, a window 40 and a roof 42 with eaves 44. The structure 36 has plain, stucco walls 46, with a painted exterior surface 48. Typically, the wall surface 48 has a rough or coarse exterior texture and is not amenable to ornamentation by typical stenciling methods.

As shown in the cross sectional view of FIG. 4, the stencil template 14 of the invention is fabricated from a closed cell foam material with a smooth top surface 50, a bottom contact surface 52 coated with a temporary stick adhesive for repeatedly adhering the stencil template 14 to a wall surface 48 of a structure 36 such as that shown in FIG. 5. Between the top surface 50 and the bottom surface 52, a closed-cell foam sheet 54 allows the surface of the stencil template to be deformed in order to conform with surface irregularities in the exterior surface 48 of the architectural structure. In the embodiment shown, the smooth top surface 50 is formed by a thin paint sheet 56 of 8 mil plastic, which is permanently bonded to the foam sheet 54 and allows excess paint to be easily removed from the template. Alternately, the paint sheet 56 may be fabricated of treated, wax impregnated paper.

In this manner, the stencil template 14 can be applied to the wall surface 48 as shown in FIG. 5 and retained in position. The stencil template 14 adheres to the wall 46 and allows the pattern cut-outs 32 to expose the wall surface 48 for application of paint thereto by use of the stipple brush 16. After the paint has been applied, the stencil template having the first cut-out pattern 32 is removed and the applied paint allowed to dry. When dried, the stencil template 14 having the second cut-out pattern 34 is applied over the first ornamentation. For proper registration of the template, registration holes 56 are used for sequential alignment of the pattern templates 20. A stipple brush 16 is used to paint small registration dots 58 on the wall surface when the first stencil template is utilized. The small registration dots 58 are not readily visible and are designed such as to blend into the overall pattern or design formed by the templates. The second stencil template having a different cut-out pattern 34 is positioned by aligning the registration holes 56 with the registration dots 58 applied with the first color. The second color is applied through the cut-out patterns 34 in the stencil template 14 and the template is then removed from the wall surface.

Although only two stencil templates have been shown for purposes of illustration, it is to be understood that additional templates can be utilized to add additional colors for the ornamentation 24. Although pattern templates 20 that are configured for corner ornamentation have been shown, it is to be understood that the entire template need not be used and portions of the template can be utilized, for example to create the extended ornamentation 60 around the door 38 of FIG. 5.

Furthermore, as shown in FIG. 3, the template kit can include a single design template 22 that simply provides a repetitive trim ornamentation 62, such as is shown applied under the eaves 44 of the house in FIG. 5. The design template 22 provides a segment of the design and can be removed and reapplied to the wall surface 34 repeatedly until the desired length of ornamentation is completed.

A preferred material for fabrication of the stencil templates is a closed cell foam sheet manufactured by Duraco, Inc. called Remo-1 that is approximately one sixteenth inch in thickness and has a permanent pressure adhesive on one side, and a removable-type adhesive on the other side. The permanent pressure adhesive allows the protective paint sheet 57 to be bonded to the closed cell foam sheet 54.

The 8 mil plastic paint sheet, preferably Mylar, or a treated heavy paper, is applied to the permanent pressure adhesive side, to provide a surface on which overlapped paint during painting can be easily removed. On the side having the removable-type adhesive, the adhesive remains on the foam sheet, but allows the template to be repeatedly applied and removed from the surface of the architectural structure to be ornamented. A protective, peel-off paper may be applied to the removable-type adhesive side for packaging. This paper would be removed and discarded before use of the templates.

Thinner or thicker foam material sheets may be used. However, a thinner material sheet requires a compatible paint sheet to maintain stiffness of the template. A thicker material sheet makes painting in tight corners of the stencil cut-out more difficult. Where the foam material is treated during fabrication to include an integral smooth top surface, the permanent adhesive and paint sheet can be omitted. However, care must be taken to provide the template with the necessary degree of stiffness to make use of the template convenient and easy.

Finally, although stipple brushes and thick paints are preferred for use with the templates, spray paint may be used where quick application is desired.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A stencil template for use in ornamentation of architectural structures comprising:

a closed-cell, deformable foam sheet having a first side with a top surface with smooth surface means for facilitating removal of applied paint, and a second side having a contact surface with a temporary stick adhesive with the characteristic of allowing the template to repeatedly adhere to a vertical, course, textured surface of an architectural structure, wherein the stencil template has cut-outs through which paint is applied to a surface to which the template is adhered.

2. A stencil kit for ornamentation of architectural structures comprising:

at least one stencil template fabricated from a closed-cell, having a deformable foam sheet having a first side with a top surface with smooth surface means for facilitating removal of applied paint, and a second side having a contact surface with a temporary stick adhesive with the characteristic of allowing the template to repeatedly adhere to a vertical, course, textured surface of an architectural structure, wherein the stencil template has cut-outs through which paint is applied to a surface to which the template is adhered, and paint means for applying paint through the cut-outs of the template onto a surface to which the template is applied.

3. The stencil kit of claim 2 wherein paint means comprises at least one stipple brush and at least one container of paint.

4. The stencil kit of claim 3 wherein the kit includes a plurality of different stencil templates with differently arranged cut-outs, and a plurality of containers of differently colored paint, wherein a multi-colored pattern or design is applyable to the surface ornamented.

5. The stencil kit of claim 2 wherein the stencil template has a thin plastic sheet bonded to the top side of the foam sheet to form the smooth top surface.

6. The stencil kit of claim 2 wherein the stencil template has a thin, treated paper sheet bonded to the top side of the foam sheet to form the smooth top surface.

7. The stencil kit of claim 2 wherein the stencil template has two segments with mitered ends joined to form an L-shaped template for corner ornamentation.

* * * * *